US009688294B2

(12) United States Patent
Lozano et al.

(10) Patent No.: US 9,688,294 B2
(45) Date of Patent: Jun. 27, 2017

(54) SYSTEMS AND METHODS FOR COLD MOVEMENT DETECTION

(71) Applicant: General Electric Company, Schnectady, NY (US)

(72) Inventors: Francisco Lozano, Paris (FR); Andrea Malesci, Sesto Fiorentino (IT); Mario Papini, Firenze (IT)

(73) Assignee: ALSTOM TRANSPORT TECHNOLOGIES, Saint-Quen (FR)

( * ) Notice: Subject to any disclaimer, the term of this patent is extended or adjusted under 35 U.S.C. 154(b) by 225 days.

(21) Appl. No.: 14/644,764

(22) Filed: Mar. 11, 2015

(65) Prior Publication Data

US 2015/0274183 A1 Oct. 1, 2015

Related U.S. Application Data

(60) Provisional application No. 61/973,522, filed on Apr. 1, 2014.

(51) Int. Cl.
*B61L 15/00* (2006.01)
*B61L 25/02* (2006.01)

(52) U.S. Cl.
CPC ..... *B61L 15/0018* (2013.01); *B61L 25/021* (2013.01)

(58) Field of Classification Search
CPC .... B61L 15/00; B61L 15/009; B61L 15/0018; B61L 25/00; B61L 25/021; B61L 25/028; B61L 13/00; B61L 13/002; B61L 13/005
See application file for complete search history.

(56) References Cited

U.S. PATENT DOCUMENTS 3,373,374 A * 3/1968 Marosi ..... G08G 1/042 324/234
3,458,802 A * 7/1969 Koerner ..... G01V 3/087 324/253

(Continued)

FOREIGN PATENT DOCUMENTS

EP 1942041 7/2008
WO 2012155836 11/2012

OTHER PUBLICATIONS

PCT Search Report and Written Opinion issued in connection with corresponding PCT Application No. PCT/US2015/20081 on Jun. 19, 2015.

(Continued)

*Primary Examiner* — Jason C Smith
(74) *Attorney, Agent, or Firm* — Christopher R. Carroll; The Small Patent Law Group, LLC.

(57) ABSTRACT

A system includes a motion switch module, an energy storage module, a resistive module, and an interface. The motion switch module includes at least one motion activated switch that is movable between an open and a closed position responsive to movement of an axle to which the motion switch module is coupled. The energy storage module includes at least one energy storage element that discharges a stored charge responsive to a motion of the corresponding at least one motion activated switch from the open to the closed position. The resistive module includes least one resistive element that dissipates energy discharged by the corresponding at least one energy storage module. The interface is configured to provide information regarding a change in charge state of the at least one energy storage element, wherein the change in charge state corresponds to a movement of the vehicle.

20 Claims, 4 Drawing Sheets

(56) References Cited

U.S. PATENT DOCUMENTS 3,571,789 A * 3/1971 Midlock ..... G08G 1/042 340/941
3,827,024 A * 7/1974 Anderson ..... B60Q 1/22 340/463
5,006,847 A * 4/1991 Rush ..... B61L 27/0022 246/122 R
5,437,422 A * 8/1995 Newman ..... B61L 27/0038 246/182 R
8,417,383 B2 * 4/2013 Ozick ..... G05D 1/0231 700/245
8,443,336 B2 * 5/2013 Vieira ..... G06F 8/10 717/104
8,453,976 B2 * 6/2013 Lauterberg ..... B61L 25/021 246/122 R
9,227,639 B1 * 1/2016 Bryant ..... B61L 3/00
2013/0178332 A1 * 7/2013 Kazama ..... B60L 15/2081 477/21
2013/0337856 A1 * 12/2013 Soderi ..... H04B 15/02 455/501
2014/0052317 A1 * 2/2014 Ko ..... B62H 5/08 701/22
2015/0274183 A1 * 10/2015 Lozano ..... B61L 25/021 246/122 R

OTHER PUBLICATIONS

M. Meyer zu Horste et al, "The GRAIL Project: Galileo Localisation for the European Train Control System", Galileo 6th Framework Programme GRAIL, Apr. 2008, pp. 1-19.

Burns, R.D, "Safety and Productivity Improvement of Railroad Operations by Advanced Train Control System", Railroad Conference, 1989. Proceedings., Technical Papers Presented at the 1989 IEEE/ASME Joint, Apr. 25-27, 1989, pp. 33-38.

* cited by examiner

SYSTEMS AND METHODS FOR COLD MOVEMENT DETECTION

RELATED APPLICATIONS

This application claims priority to U.S. Provisional Application No. 61/973,522, which was filed on 1 Apr. 2014, and is entitled "SYSTEMS AND METHODS FOR COLD MOVEMENT DETECTION" (the "'522 Application"). The entire disclosure of the '522 Application is incorporated by reference herein in its entirety.

BACKGROUND

Wayside equipment in a transportation network may be used to schedule and control the activities of one or more vehicles traversing a route (or routes) of the transportation network. However, to prevent conflicts between vehicles on the same route, or to avoid travel over sections of the route that are in need of repair or otherwise not in condition for passage of vehicles, the wayside equipment must have an accurate understanding of the position of each vehicle in the transportation network. For example, as the vehicles travel in the network, the vehicles may pass over balises, with information describing which vehicles passed over which balises at given times used to determine the position of the vehicles.

However, for example at night, a vehicle for which a location is previously known and stored in non-volatile memory may be powered off. If the vehicle is moved during the powered off period (e.g., cold movement), reports of passage over balises will not be provided to the wayside equipment. Thus, when the vehicle is powered on, although the vehicle has moved, the wayside equipment may not have a report of the movement and may erroneously schedule movements for the vehicle based on the pre-shut down position.

Current cold motion detection systems may use components such as springs that are subject to failure due to vibration of a vehicle system, or magnets which may suffer from interference (e.g., magnetic fields) encountered by vehicle systems, and/or may require an additional power supply. Current systems thus may suffer from reduced reliability, be subject to relatively fast wear requiring frequent inspection, replacement, and/or repair, and/or suffer from other drawbacks.

BRIEF DESCRIPTION

In an example of the present inventive subject matter, a cold movement detection system includes a motion switch module, an energy storage module, a resistive module, and an interface. The motion switch module is configured to be operably coupled with an axle of a vehicle, and includes at least one motion activated switch that is movable between an open and a closed position responsive to movement of the axle. The energy storage module is operably coupled to the motion switch module and includes at least one energy storage element corresponding to the at least one motion activated switch. The at least one energy storage element discharges a stored charge responsive to a motion of the corresponding at least one motion activated switch from the open to the closed position. The resistive module is operably coupled to the energy storage module and includes least one resistive element corresponding to the at least one storage element. The at least one resistive element dissipates energy discharged by the corresponding at least one energy storage module. The interface is configured to provide information regarding a change in charge state of the at least one energy storage element, wherein the change in charge state corresponds to a movement of the vehicle.

In an example of the present inventive subject matter, a method (e.g., a method for identifying a change in position of a vehicle that has been powered off) includes providing an arming charge to at least one energy storage element operably coupled to a motion switch module. The motion switch module is operably coupled with an axle of a vehicle and includes at least one motion activated switch. The at least one motion activated switch is movable between an open and a closed position responsive to movement of the axle. The method also includes storing an initial charge status of the at least one energy storage element, with the initial charge corresponding to the position of the at least one motion activated switch at an arming time. Also, the method includes reading a subsequent charge status of the at least one storage element. Further, the method includes comparing the subsequent charge status of the at least one storage element to the initial charge status of the at least one energy storage element to determine a motion of the vehicle.

In an example of the present inventive subject matter, a motion switch module configured to be operably coupled with an axle of a vehicle includes plural motion activated switches, an inner ring, an outer, and an actuator. The plural motion activated switches movable between an open position and a closed position responsive to movement of the axle. Each motion activated switch includes a button. The inner ring includes plural openings corresponding to the motion activated switches. Each opening is configured to accept a corresponding button of the corresponding motion activated switch. The outer ring is disposed radially outward and concentric with the inner ring. The actuator is configured to rotate with the axle about a center of the inner ring and outer ring. The actuator includes an opening arm configured to move at least one button radially inward to move a corresponding at least one motion activated switch from the closed position to the open position responsive to a rotating of the axle. The actuator also includes a closing shoulder configured to move at least one other button radially outward to move a corresponding least one motion activated switch from the open position to the closed position responsive to the rotating of the axle.

BRIEF DESCRIPTION OF THE DRAWINGS

The inventive subject matter will be better understood from reading the following description of non-limiting embodiments, with reference to the attached drawings, wherein below.

DETAILED DESCRIPTION

Figure 1:
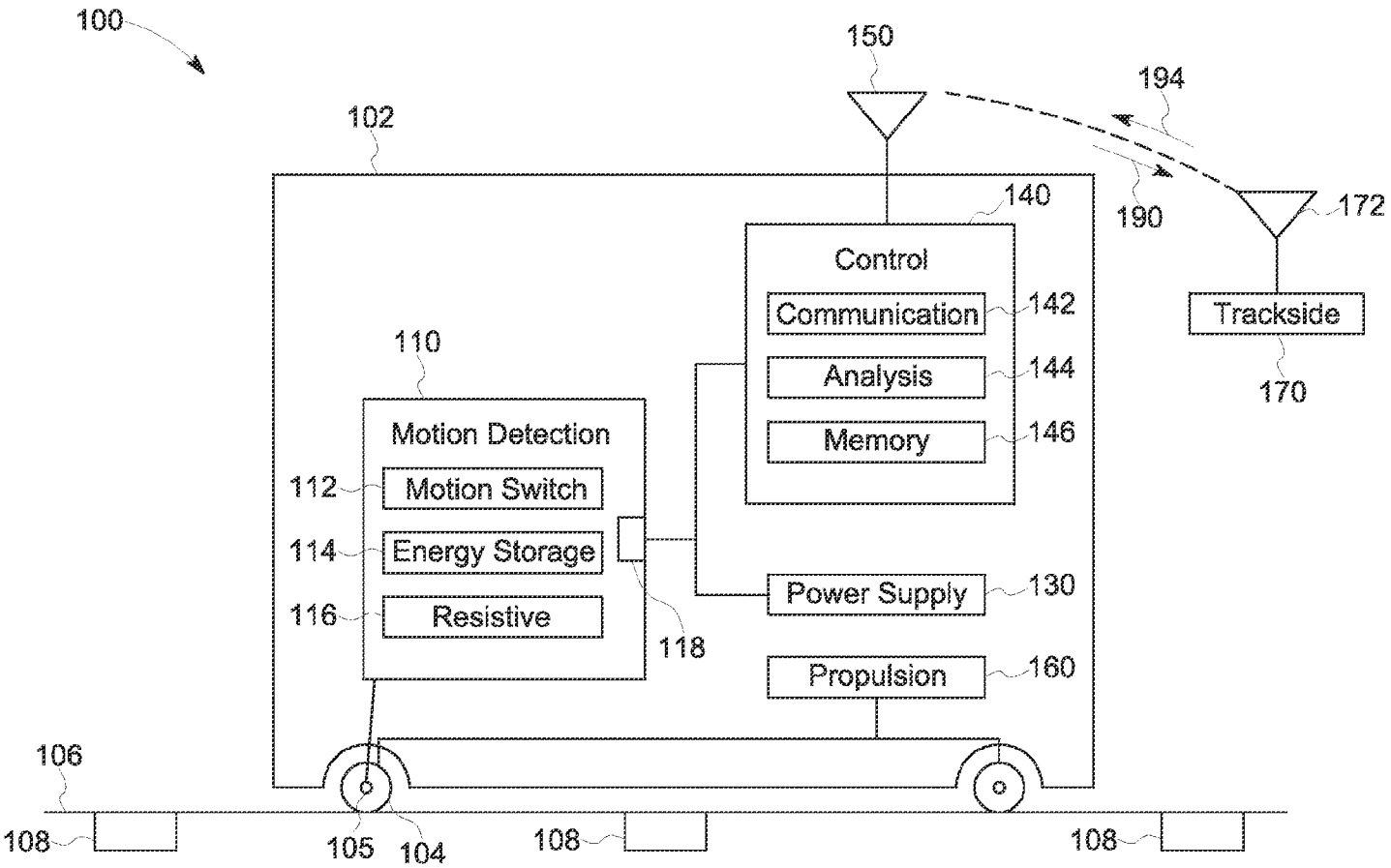
FIG. 1 is a schematic view of a vehicle system including a cold motion detection system, according to an example of the present inventive subject matter.

The term vehicle consist is used in this document. A vehicle consist can be a group of two or more vehicles that are mechanically coupled to travel together along a route. Optionally, a vehicle consist may have a single propulsion-generating unit or vehicle. The vehicles in a vehicle consist can be propulsion-generating units (e.g., vehicles capable of generating propulsive force, which also are referred to as propulsion-generating units, powered units, or powered vehicles) that may be in succession and connected together so as to provide motoring and/or braking capability for the vehicle consist. The propulsion-generating units may be connected together with or without other vehicles or cars between the propulsion-generating units. One example of a vehicle consist is a locomotive consist that includes locomotives as the propulsion-generating units. Other vehicles may be used instead of or in addition to locomotives to form the vehicle consist. A vehicle consist can also include non-propulsion generating units, such as where two or more propulsion-generating units are connected with each other by a non-propulsion-generating unit, such as a rail car, passenger car, or other vehicle that cannot generate propulsive force to propel the vehicle consist. A larger vehicle consist, such as a train, can have sub-consists. Specifically, there can be a lead consist (of propulsion-generating units), and one or more remote consists (of propulsion-generating units), such as midway in a line of cars and another remote consist at the end of the train.

The vehicle consist may have a lead propulsion-generating unit and a trail or remote propulsion-generating unit. The terms "lead," "trail," and "remote" are used to indicate which of the propulsion-generating units control operations of other propulsion-generating units, and which propulsion-generating units are controlled by other propulsion-generating units, regardless of locations within the vehicle consist. For example, a lead propulsion-generating unit can control the operations of the trail or remote propulsion-generating units, even though the lead propulsion-generating unit may or may not be disposed at a front or leading end of the vehicle consist along a direction of travel. A vehicle consist can be configured for distributed power operation, wherein throttle and braking commands are relayed from the lead propulsion-generating unit to the remote propulsion-generating units by a radio link or physical cable. Toward this end, the term vehicle consist should be not be considered a limiting factor when discussing multiple propulsion-generating units within the same vehicle consist.

As used herein, a vehicle or vehicle system may include one or more powered vehicles (or powered units) and one or more non-powered vehicles (or non-powered units). In certain embodiments, the vehicle system is a rail vehicle system that includes one or more locomotives and, optionally, one or more rail cars. In other embodiments, however, the vehicle system may include non-rail type vehicles, including off-highway vehicles (e.g., vehicles that are not designed or allowed by law or regulation to travel on public roads, highways, and the like), automobiles, marine vessels, and the like.

One or more examples of the inventive subject matter described herein provide methods and systems for improved determination of cold movement of a vehicle. For example, an initial position (e.g., a position at time immediately before a vehicle is powered off) may be determined. Then, when the vehicle is powered on, it may be determined whether or not the vehicle moved when turned off (e.g., cold movement).

In various embodiments, cold motion detection systems are composed of mechanical and electrical components configured to cooperate to detect cold motion. For example, cold motion over a detected threshold distance may be used to activate one or more switches operably coupled to an axle and configured to discharge a previously stored (e.g., stored immediately or nearly before a shutdown is initiated) charge that has been stored in one or more corresponding capacitors. The threshold distance may correspond to movement of an axle that has rotated a threshold amount (e.g., ⅓ of a rotation). By comparing the charge levels of the capacitors (or other storage elements) both before and after a shutdown, it may be determined if a vehicle has moved during the shutdown (e.g., moved the threshold distance). If the charge levels of one or more capacitors remains at a positive or non-zero value corresponding to an arming charge, for example, then the vehicle may be understood as not having moved (or as having not moved more than the threshold distance). If, however, a charge level for one or more capacitors goes from a pre-shutdown value corresponding to an arming charge to a post-shutdown value of zero (or about zero), then the vehicle may be understood as having moved.

At least one technical effect of various embodiments described herein provides reliable detection of cold movement. Another technical effect provides improved safety for systems in which vehicles may be shut down and moved during shut down. Another technical effect includes the use of few moving parts, reduced manufacturing costs, and/or reduced operating and maintenance costs. Another technical effect provides high resolution (e.g., less than one axle rotation may be detected). Another technical effect includes the elimination or reduction of use of additional power supplies, springs, and/or magnets.

FIG. 1 is a schematic view of a transportation system 100 including a vehicle system 102, a route 106, and a trackside system 170. The vehicle system 102 is configured to traverse the route 106. The vehicle system 102 depicted in FIG. 1 includes an axle 105 about which a wheel 104 is rotated to move the vehicle system 102 along the route 106. The illustrated vehicle system 102 is also configured for communication with the trackside system 170. For example, the vehicle system 102 may include a rail vehicle or consist, and the trackside system 172 may be configured to provide control commands or instructions to the vehicle system 102 to coordinate the travel of the vehicle system 102 with other vehicle systems traversing the route 106.

As indicated above, the vehicle system 102 is configured to traverse the route 106. As seen in FIG. 1, balises 108 are disposed along the route 106 and communicably coupled to the trackside system 170. The balises 108 are configured to facilitate detection of the passage of the vehicle system 102. Generally, a balise may be understood as an electronic beacon that is disposed between rails of a railway. The balise may be used as a part of an automatic train protection system. The vehicle system 102 in the illustrated embodiment provides a telepowering signal to the balise, with the balise then transmitting a "telegram" or uplink message to the vehicle system. The telegram or uplink message may contain information identifying the particular balise and/or additional information regarding, for example, track conditions such as speed limits, directional information identifying a sequence of balises, or the like.

When the vehicle system 102 passes over a given balise 108, the vehicle system 102 (e.g., an on-board processing unit of the vehicle system 102) and/or the trackside system 170 (or other off-board system) may then determine the location of the vehicle system 102 using the uplink message from the balise in conjunction with a database or other source identifying a position or location corresponding to the balise. Based on information describing which of the balises 108 have been passed over, as well as vehicle speed and distance traveled since passage over a given balise, the vehicle system 102 and/or the trackside system 170 may determine the position of the vehicle system 102. The vehicle system 102 may report the position of the vehicle system 102 to the trackside system 170, and the trackside system 170 may use the reported position in scheduling and/or permitting movements for the vehicle system 102 and/or other vehicles traversing the route 106. Additionally or alternatively, the vehicle system 102 may report passage over balises to the trackside system 170 and the trackside system 170 may determine the position of the vehicle system 102 based on the balises reported as being passed over.

However, if the vehicle system 102 is powered off and moved to a new location during a period when the vehicle is powered off (which may be referred to herein as a shutdown period), the vehicle system 102 may not detect passage over the balises 108. This movement of a vehicle that is powered off is referred to herein as "cold movement." Such "cold movement" may not be detected by the vehicle system 102 and/or the trackside system 170, resulting in the trackside system 170 erroneously using the last determined position of the vehicle system 102 before powering down as a current position. When the vehicle system 102 is powered on at the new location, the vehicle system 102 and/or the trackside system 170 may incorrectly still consider the vehicle system 102 as located at the previous location (e.g., the location immediately before powering off). To improve reliability of position determination, to improve safety, and to provide improved scheduling and dispatching, the depicted vehicle system 102 includes a cold motion detection system 110 configured to detect when the vehicle system 102 has been moved in a powered off state.

In the illustrated example, in addition to the cold motion detection system 110, the vehicle system 102 includes a power supply 130, a control unit 140, an antenna 150, and a propulsion system 160. Generally, the power supply 130 is configured to provide power (e.g., an arming power) to the cold motion detection system 110 when the vehicle system 102 is stationary before powering down (e.g., immediately or otherwise shortly before the vehicle system 102 is shut down). The control unit 140 is configured to, among other things, determine whether a cold motion (or motion during a shutdown) of the vehicle system 102 has occurred based on a comparison of one or more levels of stored energy corresponding to states of the cold motion detection system 110.

In the illustrated example, the cold motion detection system 110 includes a motion switch module 112, an energy storage module 114, a resistive module 116, and an interface 118. Generally, the cold motion detection system 110 is configured to detect the motion (e.g., provide a signal and/or information corresponding to a motion of the vehicle system 102) that occurs when the vehicle system 102 is powered off (e.g., is not able to determine position based on passage over one or more balises).

The motion switch module 112 is configured to be operably coupled with an axle 105 of the vehicle system 102. In some examples, the motion switch module 112 may include at least one motion activated switch that is movable between an open position and closed position responsive to movement (e.g., rotation of the axle). For example, one portion of the motion switch module 112 may be coupled to the axle 105 and configured to rotate with the axle 105, while another portion of the motion switch module 112 may be coupled to a portion of the vehicle system 102 (e.g., a frame) that does not rotate with the axle 105. The movement of the different portions of the motion switch module 112 relative to each other when the axle 104 rotates may be employed to move at least one motion activated switch between positions, for example from an open position to a closed position. Additional details regarding an example of a motion switch module may be seen in FIGS. 2-3 and the related discussion.

Returning to FIG. 1, the depicted energy storage module 114 is operably coupled to the motion switch module 112, and is configured to store and/or discharge electrical energy based on the position (e.g., open or closed) of one or more motion activated switches of the motion switch module 112. The energy storage module 114 includes at least one energy storage element corresponding to the at least one motion activated switch. In the illustrated embodiment, the at least one energy storage element is configured to discharge a stored charge responsive to a motion of the corresponding at least one motion activated switch from the open to the closed position. In some embodiments, the energy storage module 114 includes at least one capacitor connected in series with a corresponding at least one resistive element and a corresponding at least one motion activated switch. When the vehicle system 102 moves beyond a threshold distance (e.g., a rotation of the axle 105 exceeds a threshold amount), at least one motion activated switch of the motion switch module 112 may move from the open to the closed position to close a circuit of which the capacitor and resistive element joined in series form a part, resulting in energy stored in the capacitor being discharged and dissipated via the resistive element. In various examples, each motion activated switch may have a particular storage element (e.g., capacitor) and resistive element (e.g., resistor) dedicated thereto.

In the illustrated example, the resistive module 116 is operably coupled to the energy storage module 114, and is configured to dissipate energy that is discharged from the energy storage module 114. The resistive module 116 may be provided to avoid a short circuit occurring when the circuit is closed and energy is discharged from the energy storage module 114. The resistive module 116, for example, may include at least one resistive element corresponding to at least one storage element of the energy storage module 114 (e.g., a resistor connected in series with a capacitor of the energy storage module 114). In some embodiments, the resistive module 116 may include a plurality of resistors, one resistor for each motion activated switch/capacitor combination.

The interface 118 is configured to operably connect the motion detection module 110 (and/or one or more aspects thereof) to one or more aspects of the vehicle system 102. For example, in the illustrated example, the interface 118 operably connects the motion detection module 110 with the power supply 130 and the control unit 140. An interface, as used herein, may be understood to include one or more components, devices, and/or structures that may be coupled to a system of a vehicle (e.g., a control system) for providing information regarding the charge state or level of one or more aspects (e.g., energy storage elements such as capacitors) of the motion detection module 110. In some embodiments, the interface may include or be configured as a circuit connection point for reading a voltage across one or more energy storage devices. The depicted interface 118 is configured to provide information to the control unit 140 regarding a change in charge state of at least one energy storage element (e.g., capacitor) of the energy storage module 114. The change in charge state corresponds to a motion of the vehicle system 102, and the detected change in charge state may be used by the control unit 140 to determine that the vehicle system 102 has moved during a powered off or shut down period, and to perform one or more operations responsive to the detection and determination of the movement (e.g., alerting an off-board system of the detected cold motion). It may be noted that the use of multiple motion activated switches may be utilized to provide the ability to determine cold motion regardless of initial position of the axle (e.g., if the initial position of the axle is unknown). In various embodiments, a sufficient number of motion activated switches disposed about the axle are provided such that, regardless of axle position, at least one motion activated switch is in an open position and at least one other motion activated switch is in a closed position.

The power supply 130 is configured to provide an initial amount of energy, or arming energy, to the motion detection module 110. For example, with the vehicle system 102 stationary (e.g., the wheel 104 and axle 105 are not rotating), immediately or otherwise shortly before the vehicle system 102 is powered off, the power supply 130 may provide arming energy to the motion detection module 110. In various embodiments, the arming energy is stored by capacitors of the energy storage module. Then, when the arming energy is turned off, the stored energy of those capacitors associated with a switch in the closed position will be discharged from the capacitor and flow through the associated circuit and dissipate via an associated resistive element. The stored energy of those capacitors associated with a switch in the open position will not be discharged from the capacitor, as the associated circuit is open. Thus, those capacitors associated with an open switch will have an initial charge that may be read by the control unit. The power supply 130 may also provide power to one or more other systems or aspects of the vehicle system 102, such as the propulsion system 160. The power supply 130, for example, may include plural batteries and/or capacitors configured to store charge provided by a prime mover (not shown), such as a diesel engine coupled to a generator. The arming power may be provided automatically in some embodiments as part of a shut-down procedure executed by the vehicle system 102.

The depicted control unit 140 is disposed on-board the vehicle system and is configured to receive information regarding a charge level of one or more energy storage elements of the energy storage module 114, and to determine whether or not the vehicle system 102 has moved during a shut-down period using the charge levels of the energy storage elements. For example, the control unit 140 may store an initial charge state (e.g., in persistent memory that is a part of or otherwise accessible to the control unit 140) for each energy storage element before powering off of the vehicle system 102. Then, when the vehicle system 102 is powered on after a period of shut down, the control unit 140 may receive information via the interface 118 describing a subsequent, post-shut down charge state for each energy storage element, and compare the post-shut down charge state for each energy storage element with the pre-shut down charge state of each energy storage element. If any charge state has changed (e.g., the charge state for one or more energy storage elements has gone from a positive value corresponding with the arming energy to a zero or near-zero level), the control unit 140 may determine that motion has occurred during the shut-down period. The control unit 140 may also be configured to provide control instructions or otherwise control operations of one or more additional portions or aspects of the vehicle system 102, such as the propulsion system 160.

The depicted control unit 140 includes a communication module 142, an analysis module 144, and a memory 146. The communication module 142 is configured to prepare messages for transmission to the trackside system 170 (and/or other off-board system), and to receive messages (e.g., requests for additional information, instructions for controlling the vehicle system 102). The memory 146 is configured to store energy charge levels for each energy storage element of the energy storage module 114. The analysis module 114 is configured to compare the charge states or levels of the energy storage elements after a period of shut down with the charge levels before the period of shut down, and to determine, based on the comparison, whether the vehicle system 102 has moved at least a threshold distance during the shutdown. For example, if at least one charge level or state has changed, the control unit 140 may determine that the vehicle system 102 has moved. Responsive to the determined movement, the communication module 142 may prepare a message 190 to be sent to the trackside system 170 via the antenna 150 of the vehicle system 102 and the antenna 172 of the trackside module 170. The message 190 may inform the trackside module 170 that the vehicle system 102 has moved, and that any previously stored (e.g., pre-shut down) information describing the position of the vehicle system 102 may be incorrect and should be disregarded and/or further evaluated. The message 190 may also include a request for authorization for the vehicle system 102 to move. The length of the distance for which the vehicle is authorized to move may depend, for example, on the route or the signaling conditions, among others. Generally, the vehicle system 102 may move a distance sufficient for one or more balises 108 to be passed over to determine the current location or position of the vehicle system 102 along the route 106.

Generally, in various embodiments, the control unit 140 may be understood as a processing circuitry module and may include processing circuitry such as one or more field programmable gate array (FPGA), application specific integrated circuit (ASIC), or microprocessor. The control unit 140 in various embodiments may be configured to execute one or more algorithms to perform functions or operations described herein. The one or more algorithms may include aspects of embodiments disclosed herein, whether or not expressly identified in a flowchart or as a step of a method disclosed herein.

The depicted propulsion system 160 is configured to provide tractive and/or braking efforts for moving the vehicle system 102 along the route. For example, the propulsion system 160 may include one or more motors (e.g., a motor provided with power from a prime mover such as a diesel engine via a generator) and one or more brakes (e.g., hydraulic brakes, air brakes) for moving the vehicle system 102 along route the 106 (in both directions). The propulsion system 160 may receive commands or instructions from the control unit 140 to control the operations performed by the propulsion system 160 and/or settings of components of the propulsion system 160.

The trackside system 170 is an example of an off-board system. The trackside system 170 is configured to schedule movement of the vehicle system 102 as well as other vehicles through a transportation network including the route 106. For example, the trackside system 170 may determine the position of the vehicle system 102 (e.g., using information regarding balises that the vehicle system 102 has passed over), and control the movement of the vehicle system 102 based on the position of the vehicle system 102, the direction of the movement of the vehicle system 102, the condition of any upcoming portions of the route 106 which the vehicle system 102 will encounter, the position and/or movement of any other vehicles along an upcoming portion of the route 106, or the like. For example, the vehicle system 102 may provide a movement authorization request to the trackside system 170 requesting permission for the vehicle system 102 to move (e.g., at a given speed) over a portion of the route 106 in any direction (depending on the signaling conditions). The trackside system 170 may determine if there are any conflicts between the requested movement and any current or upcoming movements of other vehicles, and also if there are any faults or impediments along the upcoming portion of the route 106. If there are no conflicts or impediments, the trackside system 170 may issue a movement authorization to the vehicle system 102 permitting the requested movement. If there are conflicts or impediments, the trackside system 170 may deny the request and instruct the vehicle system to remain stationary (or travel at a reduced speed) until the conflict or impediment is resolved or cleared from the upcoming requested path of the vehicle system 102.

For example, after receiving a message (e.g., message 190) from the vehicle system 102 informing the trackside system 170 that the vehicle system 102 has moved during a period of shut-down and/or requesting authorization for a movement sufficient to determine the location of the vehicle system 102, the trackside system 172 may send a movement authorization via a message 194 to the vehicle system 102. The movement authorization sent via the message 194 may be a limited authorization, that allows only manual control of the vehicle system 102 to move at a limited speed and/or for a limited distance. For example, the limited distance may be limited to an amount to pass over two balises 108. (Passage over two balises 108 may provide sufficient information to both determine the position of the vehicle system 102 as well as the direction of the vehicle system 102).

Figure 2:
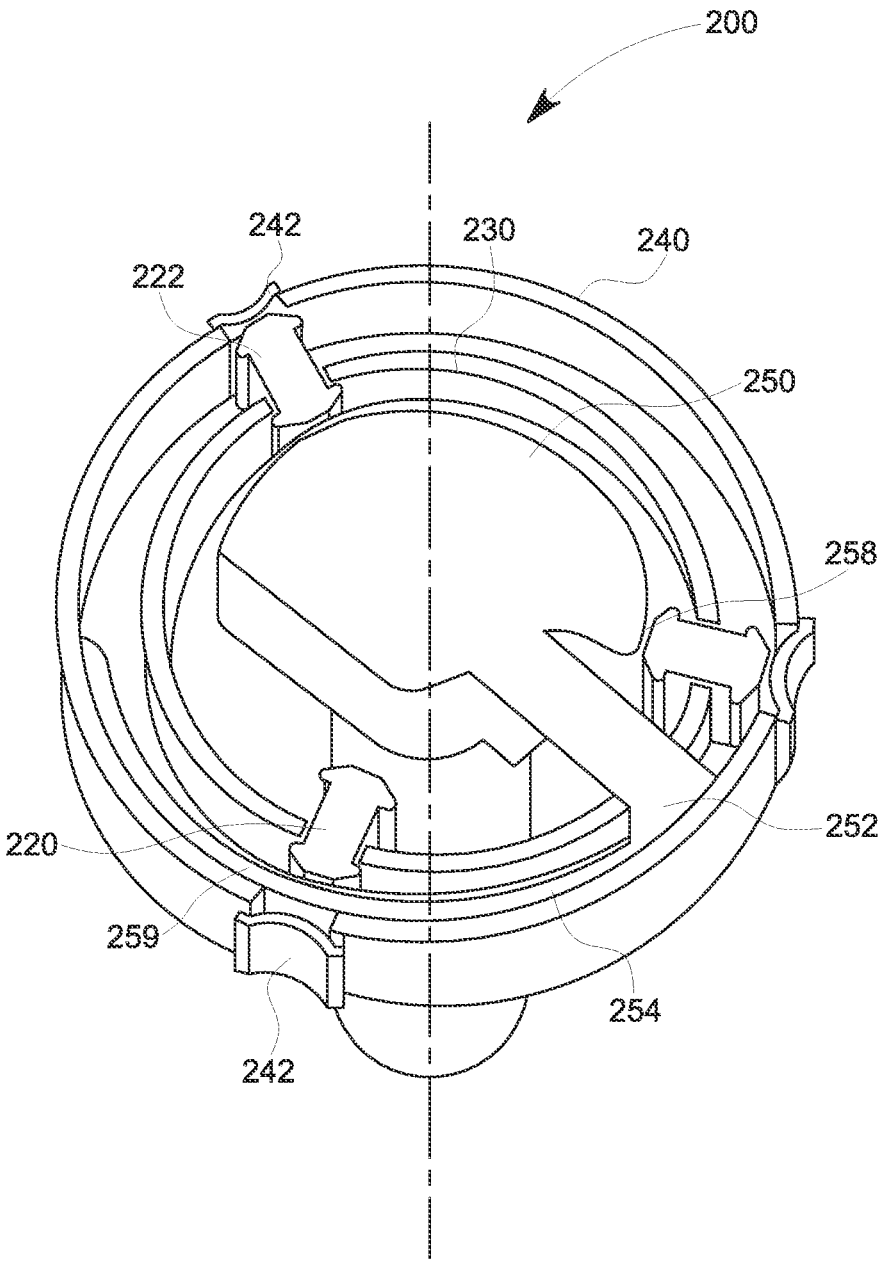
FIG. 2 is a circuit diagram of a cold motion detection system, according to an example of the present inventive subject matter.
Figure 3:
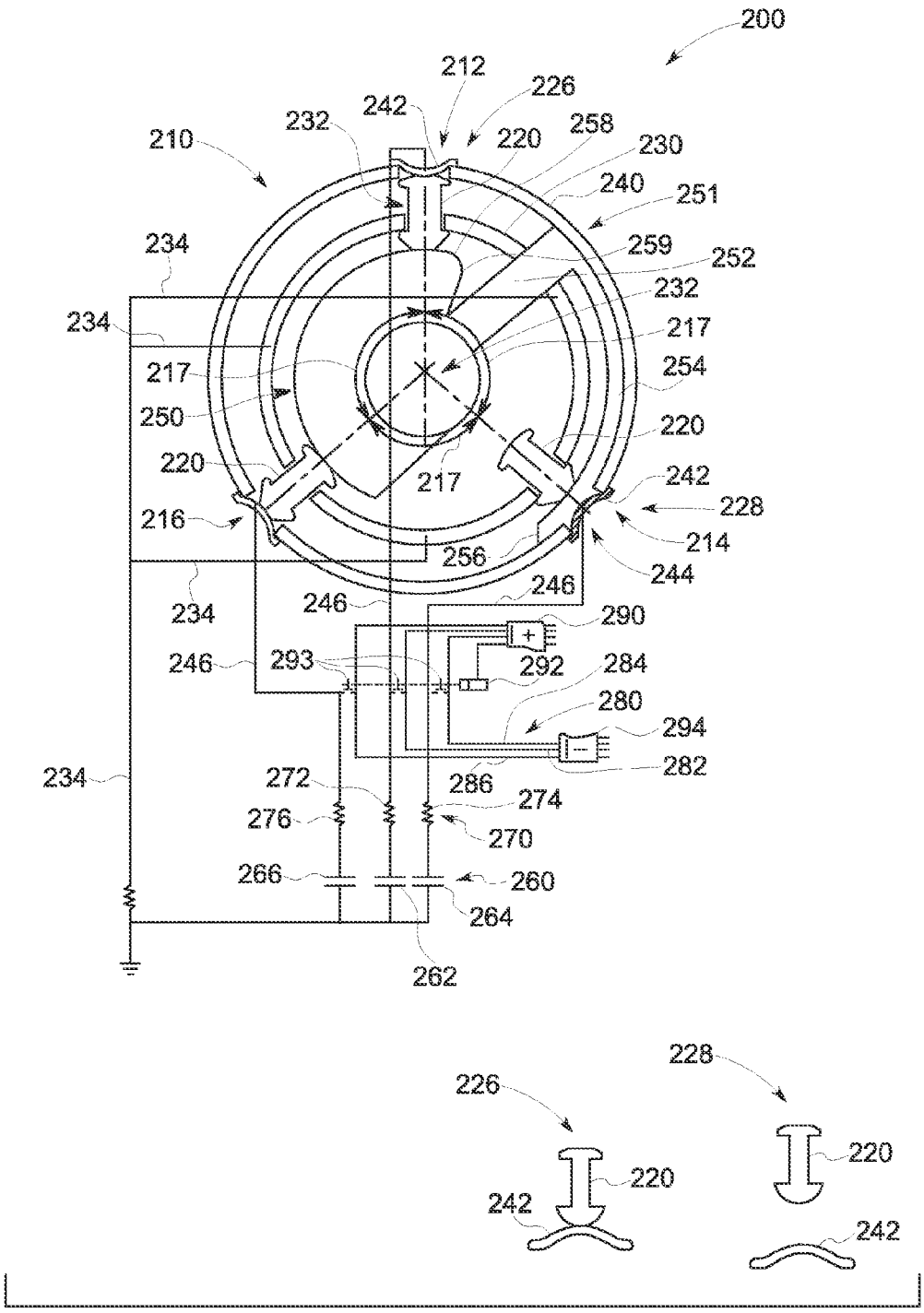
FIG. 3 is a perspective view of the cold motion detection system of FIG. 2.

An example of a cold motion detection system 200 formed in accordance with one example of the present inventive subject matter is shown in FIGS. 2-3. FIG. 2 is a perspective view of aspects of the cold motion detection system 200, and FIG. 3 is an electrical schematic of the cold motion detection system. The cold motion detection system 200 or one or more aspects thereof may be utilized, for example, as part of or in conjunction with the cold motion detection system 110 of the example of FIG. 1. The cold motion detection system 200 illustrated in FIGS. 2 and 3 includes a motion switch module 210, an energy storage module 260, a resistive module 270, and an interface 280. Various aspects of the cold motion system 200 may be joined by conductive pathways (e.g., wires, cables, buses, or the like) to form circuits. The cold motion detection system 200 is disposed about a center 232 of an axle to which the cold motion detection system 200 is operably coupled. When the axle rotates, one or more switches of the cold motion detections system 200 are moved from an open to a closed position, resulting in the closing of a circuit and the discharge of energy from an energy storage element. The discharge of energy may be detected (e.g., by a control unit such as the control unit 140) by comparing a pre-shut down charge level with a post-shut down charge level, and used to identify cold motion (or motion during a shut-down period). It may be noted that one or more cold motion detection systems 200 may be mounted per powered unit of a consist in some examples.

The cold motion detection system 200 is coupled to a power supply 290 and a reading unit 294 via a relay 292. The relay is configured to allow arming the cold motion detection system 200. The power supply 290 is configured to provide an arming charge to the cold motion detection system 200, and the reading unit 294 (which may in communication with or form a portion of a control unit such as control unit 140) is configured to read charge levels of energy storage elements of the cold motion detection system 200.

In the illustrated example, the motion switch module 210 includes an inner ring 230, an outer ring 240, an actuator 250, and buttons 220. The buttons 220 are configured to cooperate with aspects of the inner ring 230 and the outer ring 240 to form switches movable from an open position 228 (at which position an associated circuit will be open) and a closed position 226 (at which position an associated circuit will be closed). The actuator 250 is configured to open or close the switches (e.g., via a radial movement of the buttons 220 radially inward toward the center 232 or radially outward away from the center 232) responsive to movement of the axle to which the motion switch module 210 is coupled. In the depicted example, the inner ring 230 and the outer ring 240 are fixed to a frame or other non-rotating portion of a vehicle, and the actuator 250 fixed to the axle so that the actuator 250 rotates with the axle but the inner ring 230 and the outer ring 240 do not rotate with the axle.

The inner ring 230 includes button openings 232 and ring conductive pathways 234. The inner ring 230 is a generally circular ring formed about the center 232, and is formed from a conductive material. The button openings 232 are configured to slidingly accept the buttons 220 and to place the inner ring 230 in electrical communication with the buttons 220. The buttons 220 in the illustrated embodiment are also made of a conductive material, so that the buttons 220 may cooperate with the inner ring 230 to form a portion of one or more electrical circuits (e.g., circuits include storage elements and resistive elements).

The outer ring 240 is a generally circular ring disposed a clearance distance radially outward from the inner ring 230 about the center 232. The clearance distance is sized to allow movement of a portion of the actuator as well as movement of the buttons 220 between the open position 228 and the closed position 226. The outer ring 240 includes caps 242 disposed in cap openings 244, and cap conductive pathways 246. The cap openings 244 are generally aligned with the button openings 232 of the inner ring 230. The caps 242 are disposed within the cap openings 244, and are formed of an electrically conductive material. In the illustrated example, the remainder of the outer ring 240 is formed of an electrically insulating material. The cap conductive pathways 244 electrically connect the caps 242 with one or more electrical circuits (e.g., circuits include storage elements and resistive elements). When a corresponding button 220 contacts a cap 242, the switch including the given button 220 and cap 242 is placed in the closed position 226, and an electrical circuit including the given button 220 and cap 242 combination forms a closed circuit through which current may readily flow. When the corresponding button 220 is disposed a distance from the cap 242, the switch including the given button 220 and cap 242 is placed in the open position 228, and an electrical circuit including the given button 220 and cap 242 combination forms an open circuit through which current may not readily flow.

As indicated above, various portions of the inner ring 230 and outer ring 240, as well as the buttons 220, cooperate to form switches. For example, in the example depicted in FIGS. 2 and 3, the motion switch module 210 includes three switches. A first switch 212, in the closed position 226, is shown in the top, or 12:00 position as seen in FIG. 3. A second switch 214, in the open position 228, is shown in the lower right, or 4:00 position as seen in FIG. 3. A third switch 216, in the closed position 226, is shown in the lower left, or 8:00 position as seen in FIG. 3. The switch positions are separated from each other by a spacing 217. In the illustrated embodiment, the spacing 217 is about 120 degrees. Thus, the three switches are equally disposed about the inner and outer rings. Other numbers of switches, spacings, configurations of the actuator, or the like may be used in various embodiments. The switches form portions of circuits with energy storage elements and resistive elements. In the illustrated embodiment, each switch is connected in series with an energy storage element (e.g., a capacitor) and a resistive element (e.g., a resistor). Each switch, along with the associated energy storage element and resistive element, forms part of a switch circuit. Thus, in the depicted example, the first switch 212 and associated capacitor and resistor form a portion of a first switch circuit, the second switch 214 and associated capacitor and resistor form a portion of a second switch circuit, and the third switch 216 and associated capacitor and resistor form a portion of a third switch circuit.

The actuator 250 is coupled to the axle and configured to rotate with the axle. As the actuator 250 rotates about the center 232, the actuator 250 moves one or more switches from the open position 228 to the closed position 226 and/or from the closed position 226 to the open position 228. In the illustrated embodiment, the actuator 250 includes an opening arm 251 and a closing shoulder 258.

The opening arm 251 (which extends from a central portion of the actuator 250) includes a radial extension 252 and a separation arm 254. The separation arm 254 includes an opening leading surface 256. The separation arm 254 is disposed at a radial distance from the center 232 between the inner ring 230 and outer 240. The radial extension 252 (which passes over the inner ring 230 as seen in FIG. 2) maintains the separation arm 254 in position between the inner ring 230 and the outer ring 240. The separation arm 254 is sized and positioned so that the separation arm 254 contacts buttons 220 in the closed position (e.g., in contact with a cap) as the axle rotates and moves the buttons encountered in the closed position to the open position (e.g., disposed a radial distance away from the cap). In the illustrated example, the opening leading surface 256 is shown as encountering buttons in the closed position as the separation arm 254 rotates clockwise. Alternatively or additionally, an opening leading surface may be positioned on the opposite end of the separation arm to open switches encountered during a counter-clockwise rotation.

The closing shoulder 258 is disposed radially inwardly from the separation arm 254, and includes a closing leading surface 259. The closing leading surface 259 is positioned and configured such that, as the actuator 250 rotates clockwise, the closing leading surface 259 contacts buttons that are in the open position (e.g., disposed a radial distance from a cap) and moves the buttons previously in the open position to the closed position (e.g., in contact with the cap). In the illustrated example, the opening leading surface 259 is shown as encountering buttons in the closed position as the separation arm 254 rotates clockwise. Alternatively or additionally, a closing leading surface may be positioned to close open switches encountered during a counter-clockwise rotation.

The depicted energy storage module 260 includes three capacitors configured to store charge representing the state of a corresponding switch. The energy storage module 260 in the illustrated example includes a first capacitor 262 operably coupled in series with the first switch 212, a second capacitor 264 operably coupled in series with the second switch 214, and a third capacitor 266 operably coupled in series with the third switch. Generally, when a given switch is in the open position, current may not readily flow through the associated circuit including the corresponding capacitor, and the charge level is generally maintained within the corresponding capacitor. However, when a given switch is in the closed position, current may readily flow through the associated circuit including the corresponding capacitor, and the charge from the capacitor is discharged into the circuit.

The current discharged into a corresponding circuit by one or more capacitors is dissipated by the resistive module 270. The resistive module 270 in the illustrated example includes a first resistor 272 connected in series with the first capacitor 262 and the first switch 212, a second resistor 274 connected in series with the second capacitor 264 and the second switch 214, and a third resistor 276 connected in series with the third capacitor 266 and the third switch 216. For example, when the first switch 212 is in the closed position, the corresponding circuit is closed, and charge stored in the first capacitor 262 provides a current through the circuit, resulting in energy being dissipated by the first resistor. The circuits associated with the second switch 214 and third switch 216 may operate generally similarly. Thus, when a given switch is in the closed position, the charge level of the corresponding capacitor goes to zero as energy is dissipated by the associated resistor.

The interface 280 includes conductive pathways configured to allow a control unit (e.g., control unit 140) or reading device (e.g., reading unit 294) to determine charge stored in the capacitors of the energy storage module 260. The interface 280 may provide one or more circuit connection points and/or conductive pathways between a given capacitor and a device or system configured to determine the charge level or state of the capacitor. In the depicted example, the interface 280 includes a first interface 282 configured to place the reading unit 294 in electrical communication with the first capacitor 262, a second interface 284 configured to place the reading unit 294 in electrical communication with the second capacitor 264, and a third interface 286 configured to place the reading unit 294 in electrical communication with the third capacitor 266.

The power supply 290 is configured to provide an arming charge to the energy storage module 260, and the reading unit 294 is configured to read the stored charge of the capacitors of the energy storage module 260. The relay 292 is configured to selectively connect the energy storage module 260 and associated circuits with the power supply 290 and the reading unit 294. The relay 292 may operate relay switches 293 to selectively couple the various switches and associated circuits with the power supply 290 and/or the reading unit 294.

The operation of the cold motion detection system 200 will next be discussed. In one example scenario, a vehicle system is brought to a stop with the cold motion detection system 200 oriented and positioned as shown in FIG. 3. Thus, the first switch 212 and the third switch 216 are in the closed position 226, with the corresponding buttons 220 and caps 242 in contact with each other. The second switch 214, however, is in the open position, with the separation arm 254 interposed between the corresponding button 220 and cap 242 to place the button 220 and cap 242 a radial distance apart and preventing the ready flow of current therebetween.

Next, before the vehicle is shut down, an arming charge from the power supply 290 is provided to the energy storage module 260. The relay 292 may be operated (e.g., by a control unit such as control unit 140) to provide energy from the power supply 290 to each of the circuits associated with the first switch 212 (e.g., a circuit including the first resistor 272 and the first capacitor 262 connected in series with the first switch 212), the second switch 214, and the third switch 216. While the power is supplied, energy or charge builds up in the capacitors for all three switches and is stored. The stored energy corresponds to the amount of arming charge delivered and the time over which the arming charge is provided.

Once sufficient energy (e.g., a measurable amount over a predetermined threshold) is stored in each capacitor, the relay 292 is operated to disconnect the power supply 290 from the circuits of the switches, and to place the circuits of the switches in electrical communication with the reading unit 294. With the arming charge no longer supplied, each capacitor starts with a charge corresponding to the previously supplied arming charge at the time of initial withdrawal of the arming charge. However, because the first switch 212 and the third switch 216 are in the closed position 226, current may flow freely through the corresponding circuits. Thus, the charge stored in the first capacitor 262 and the third capacitor 266 furnishes a current through the corresponding circuits, and the charge of the first capacitor 262 and the third capacitor 266 are reduced to zero or near zero as energy is dissipated by the first resistor 272 and the third resistor 276, respectively, after the withdrawal of the arming charge. However, because the second switch 214 is in the open position 228, charge may not flow readily through the second switch 214 and associate circuit, and the second capacitor 262 retains the energy corresponding to the arming charge.

The reading unit 294 may be used to read the charge of each capacitor at an initial state following the arming charge and dissipation of charge following shut-off of the arming charge, but before vehicle shutdown. (If the reading process discharges the capacitors, the capacitors may be charged again.) Thus, at an initial state, for the illustrated example, the charge levels of the first capacitor is zero, the charge level of the second capacitor 214 is a positive value corresponding to the arming charge, and the charge level of the third capacitor 216 is zero. These charge levels may be read by the reading unit 294, provided to a control unit (e.g., control unit 140) and stored in a persistent memory (e.g., a memory that will be preserved during shutdown of the vehicle). It may be noted that, because no arming charge is provided during the shutdown, those capacitors with a zero initial charge at the time of shutdown will remain at zero charge throughout the shutdown, and thus charge levels of zero may be discarded. However, in some embodiments, zero charge levels may be saved and used as a safety check. For example, if a capacitor's charge is read as changing from zero to a positive value, a warning flag may be raised concerning the reliability of the information provided. Generally, in various embodiments, an final or subsequent status of the capacitors is compared to an initial status. If the status is identical, no motion is detected, but if the status is different, motion is detected. In various embodiments, a capacitor status may change from charged to uncharged and/or from uncharged to charged.

Next, the vehicle may be shut down. If the vehicle does not move (e.g., the axle coupled to the cold motion detection system 200 does not rotate), the charge level in the second capacitor 214 will be preserved at or about the initial state (e.g., the state at the time of shutdown). If, however, the axle rotates during the shutdown, the actuator 250 will rotate. In the illustrated example, the closing leading surface 259 of the closing shoulder 258 is slightly less than 120 degrees from the button 220 of the second switch 214. Thus, if the axle and associated closing shoulder 258 or the actuator 250 are rotated about 120 degrees clockwise or more during shutdown, the closing leading surface 259 will contact the button 220 of the second switch 214, and move the button 220 radially outward into contact with the cap 242 of the second switch 214. (It may be noted that, depending on the initial position of the axle, the rotation may be less than 120 degrees. For example, a motion activated switch may be closed (or opened) almost immediately if the closing leading surface 259 or the opening leading surface 256 is positioned very close to the switch at the initial position.) The contact will close the circuit associated with the second switch 214, allowing current to readily flow, and result in the discharge of the energy stored in the second capacitor 264. The charge level of the second capacitor 264 will thus drop to zero or near zero. As the opening leading surface 256 encounters closed switches, those switches will be opened; however, the charge level for such switches will remain at zero as no arming charge is provided during shutdown for the illustrated example. In the illustrated embodiment, the switches are spaced at about 120 degrees, and the closing leading surface 259 is disposed at least 120 degrees (in the illustrated example, more than 120 degrees) from the opening leading surface 256. Thus, regardless of where the separation arm 254 and closing shoulder 258 are positioned during the rotation of the actuator 250, at least one switch will be in the open position and at least one switch will be in the closed position. For example, if the separation arm 254 is in position such that the second and third switches are in the open position, the first switch 212 will be in the open position.

For the example scenario discussed above (e.g., an initial positive charge saved for the second capacitor 264), when the vehicle is powered up, the reading unit 294 may be used to read the charge levels of the capacitor. If the charge level of the second capacitor 214 remains at a positive value at or near the initial charge, then the axle may be understood as having not moved, or as having rotated less than 120 degrees, and it may be determined that no cold movement has occurred. However, if the charge of the second capacitor is at or near zero, the vehicle may be understood as having experienced cold movement, and appropriate action taken to determine the correct vehicle location.

Thus, in various examples, cold motion may be detected without the use of magnets, springs, or other components affected by vibration or other conditions commonly encountered during rail vehicle travel. The cold motion detection system of various examples of the present invention allows for inexpensive and/or compact cold motion detection systems, with relatively few moving parts. Various examples provide for the combined use of electrical and mechanical components to reliably detect cold motion. In some examples, a clutch mechanism may be provided to disengage the actuator from the axle at relatively high speeds and to engage the actuator at slow speeds (e.g., slow speeds encountered prior to a shutdown), thus reducing wear even further while still ensuring that at least one switch is in an open position and at least one switch is in a closed position when the vehicle is at a shutdown location.

Figure 4:
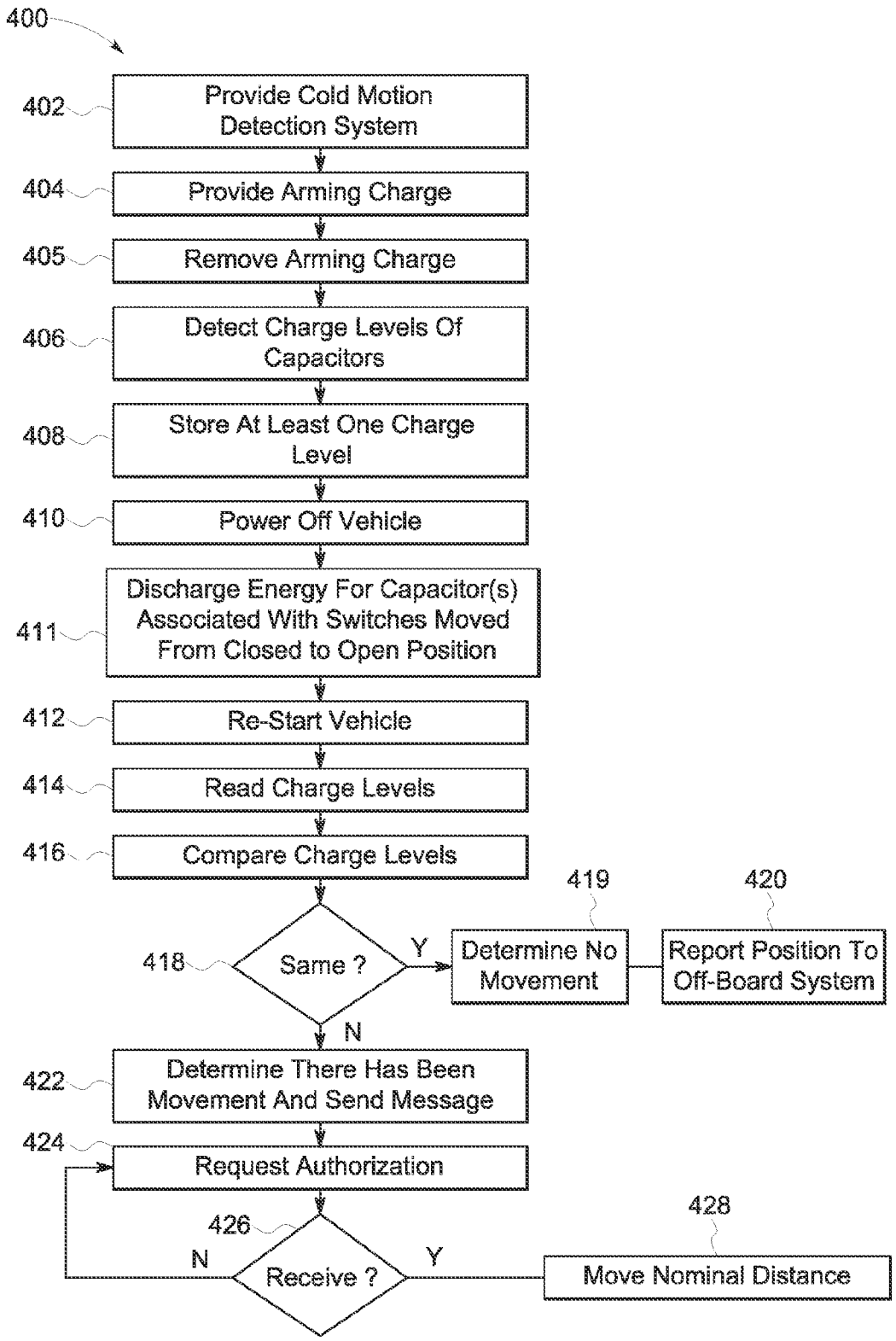
FIG. 4 is a flowchart of a method for cold motion detection, according to an example of the present inventive subject matter.

FIG. 4 illustrates a flowchart of a method 400 for determining cold motion of a vehicle or vehicle system in accordance with an example. The method 400 may be performed, for example, using certain components, equipment, structures, or other aspects of embodiments discussed herein. In certain embodiments, certain steps may be added or omitted, certain steps may be performed simultaneously or concurrently with other steps, certain steps may be performed in different order, and certain steps may be performed more than once, for example, in an iterative fashion. In various embodiments, portions, aspects, and/or variations of the method 400 may be able to be used as one or more algorithms to direct hardware to perform operations described herein.

At 402, a cold motion detection system (e.g., cold motion detection system 200) is provided. The cold motion detection system may be coupled to an axle and one or more additional portions of a vehicle. Generally, the cold motion detection system may be mechanically mounted such that at least one portion of a motion activated switch moves with the rotation of the axle and at least one portion does not. The cold motion detection system may also be coupled to a power supply (e.g., to provide an arming charge to the cold motion detection system). Further, the cold motion detection system may also be coupled to a control unit or other unit configured to read, store, and analyze the charge levels or states of one or more energy storage elements (e.g., capacitors) of the cold motion detection system at various times (e.g., before shutdown and after shutdown). The cold motion detections system may include a plurality of motion activated switches movable between open and closed positions, with each motion activated switch associated with (e.g., wired in series as part of a circuit with) a capacitor that is dedicated to the particular motion activated switch.

At 404, an arming charge is provided to the cold motion detection system. The arming charge, for example, may be provided from a power supply of the vehicle after the vehicle has stopped moving but before the vehicle is shut down. The arming charge and subsequent operations may be performed as part of an automatic sequence performed by one or more systems or components of the vehicle as part of a shutdown procedure or protocol. Once the arming charge has been applied for a long enough time to provide a full or substantial charge to capacitors of the cold motion detection system, the arming charge may be removed at 405. Once the arming charge is removed, energy from capacitors associated with switches in the closed position (e.g., circuit closed) will dissipate (e.g., through associated resistors) and the charge state of the capacitors will drop to about zero, whereas energy from capacitors associated with switches in the open position (e.g., circuit not closed) will not be dissipated and the charge level in the capacitors will remain at a non-zero value associated with the arming charge.

At 406, the charge level for each capacitor of the cold motion detection system is read or detected, for example by a reading unit (e.g., meter) and/or aspect of a control unit.

At 408, the charge level for at least one capacitor is stored. In some examples, the charge level associated with each switch (e.g., the charge stored in the capacitor associated with the given switch) is stored in a persistent memory. In other example, only those charge levels corresponding to the arming charge are stored.

At 410, the vehicle is powered off or shut down. If the vehicle moves (e.g., the axle to which the cold motion detection system is coupled rotates) beyond a threshold distance, at least one of the switches associated with a capacitor holding a charge will be moved from the open position to the closed position. For each switch moved from the open position to the closed position, current is allowed to flow freely and any charge stored in the associated capacitor is discharged at 411 and dissipated, for example by a resistor wired in series with the capacitor.

At 412, the vehicle is powered on or re-started.

At 414, the charge for each capacitor is read, for example by the reading unit (e.g., meter) and/or aspect of a control unit used at 406.

At 416, the charge level for at least one capacitor read at 414, or after the shutdown period, is compared to the level saved for the at least one capacitor at 408, or the pre-shutdown charge level. In some examples, only the charge levels for those capacitors having a pre-shutdown level corresponding to the arming charge, or those capacitors associated with a switch in the open position at shut down are compared with pre-shutdown levels, while in other examples the charge levels for all capacitors are compared to the corresponding pre-shutdown level.

At 418, if the charge levels are the same, it is determined at 419 that the vehicle has not moved, or has moved less than a threshold distance. The threshold distance may correspond, for example, to less than one rotation of an axle (e.g., about ⅓ of a rotation). If no movement (or no movement meeting or reaching the threshold distance) is detected or determined, at 420 the vehicle reports its position to a trackside system or other off-board system (e.g., a scheduling or dispatching system) as being the same as the position at shutdown. For example, the vehicle may report a specific position or location saved in memory as the pre-shutdown location. As another example, the vehicle may send a message to the trackside system or other off-board system indicating that there has been no change in position since shut down.

If the charge level has changed (e.g., a charge level has changed from a pre-shutdown level corresponding to the arming charge to a post-shutdown level of about zero corresponding to a movement of an associated switch from the open position to the closed position), it is determined at 422 that a movement has occurred. At 422, a message is sent to the trackside system or other off-board system that the vehicle has moved. Thus, the trackside or other off-board system may disregard any previously saved position for the vehicle and initiate one or more operations to determine the current position of the vehicle.

In the illustrated embodiment, at 424, the vehicle requests authorization to move a nominal distance to determine position. For example, the vehicle may request to move, under manual control, a given distance at a relatively low rate of speed to allow the vehicle to pass over at least two balises. Reports regarding the specific balises passed over may be used to determine the location of the vehicle as well as the direction the vehicle is headed. It may be noted that, additionally or alternatively, other techniques for vehicle location may be employed in various embodiments.

At 426, it is determined if the vehicle has received authorization to move up to a safe point according to the signaling situation. If the vehicle has received such authorization to move, while the vehicle is moving at 428, the trackside or other system may determine the vehicle location based on the balises passed over. If the authorization is not received, the method may return to 424 and a movement authorization may be requested again. If the position of the vehicle system cannot be determined, in various embodiments the vehicle system may receive authorization to move only under the supervision of the operator, checking the maximum speed and/or the maximum distance and/or a list of balises. This depends on the configuration of the trackside.

In an example of the present inventive subject matter, a cold movement detection system includes a motion switch module, an energy storage module, a resistive module, and an interface. The motion switch module is configured to be operably coupled with an axle of a vehicle, and includes at least one motion activated switch that is movable between an open and a closed position responsive to movement of the axle. The energy storage module is operably coupled to the motion switch module and includes at least one energy storage element corresponding to the at least one motion activated switch. The at least one energy storage element is configured to discharge a stored charge responsive to the corresponding at least one motion activated switch moving from the open to the closed position. The resistive module is operably coupled to the energy storage module and includes least one resistive element corresponding to the at least one storage element. The at least one resistive element is configured to dissipate energy of the stored charge discharged by the corresponding at least one energy storage module. The interface is configured to provide information regarding a change in charge state of the at least one energy storage element, wherein the change in charge state corresponds to the movement of the vehicle.

In another aspect, the at least one energy storage element comprises a capacitor connected in series with the corresponding at least one resistive element and the corresponding at least one motion activated switch. A discharging of the capacitor corresponds to the movement of the vehicle. It may be noted that, in some embodiments, a relatively small amount of movement (e.g., less than one meter) may be disregarded. Thus, more than one capacitor (e.g., three capacitors, or all capacitors) may be required to be discharged before the vehicle is considered to have moved beyond a nominal acceptable distance.

In another aspect, the at least one motion activated switch of the motion switch module comprises three motion activated switches spaced about 120 degrees apart from each other.

In another aspect, the at least one motion activated switch includes a corresponding at least one button, and the motion switch module includes an inner ring, an outer ring, and an actuator. The inner ring is configured to accept the at least one button of the at least one motion activated switch. The outer ring is disposed radially outward and concentric with the inner ring. The actuator is configured to rotate with the axle about a center of the inner ring and outer ring, and includes an opening arm configured to move the at least one button radially inward to move the at least one motion activated switch from the closed position to the open position responsive to a rotating of the axle. The actuator also includes a closing shoulder configured to move the at least one button radially outward to move the at least one motion activated switch from the open position to the closed position responsive to the rotating of the axle. For example, the at least one motion activated switch of the motion switch module may include three motion activated switches spaced about 120 degrees apart from each other. The opening arm may include an opening leading surface configured to initiate radially inward movement of the button and the closing shoulder may include a closing leading surface configured to initiate radially outward movement of the button, with the opening leading surface and the closing leading surface spaced at least 120 degrees apart. Additionally or alternatively, the outer ring may include at least one cap corresponding to the at least one button, the at least one cap contacting the corresponding at least one button when the at least one motion activated switch is in the closed position. The at least one cap may be spaced a distance apart from the corresponding at least one button when the at least one motion activated switch is in the open position, wherein the charge stored in the at least one storage element is discharged when the corresponding at least one cap contacts the corresponding at least one button. In some examples, the inner ring and the at least one cap may be electrically coupled to the at least one energy storage element. The outer ring may be electrically insulated.

In an example of the present inventive subject matter, a method (e.g., a method for identifying a change in position of a vehicle that has been powered off) includes providing an arming charge to at least one energy storage element operably coupled to a motion switch module. The motion switch module is operably coupled with an axle of a vehicle and includes at least one motion activated switch. The at least one motion activated switch is movable between an open and a closed position responsive to movement of the axle. The method also includes storing an initial charge status of the at least one energy storage element, with the initial charge corresponding to the position of the at least one motion activated switch at an arming time. Also, the method includes reading a subsequent charge status of the at least one storage element. Further, the method includes comparing the subsequent charge status of the at least one storage element to the initial charge status of the at least one energy storage element to determine a motion of the vehicle. As discussed herein, plural motion activated switches may be distributed about an axle such that any cold motion may be detected irrespective of initial position.

In another aspect, the initial charge status is about zero when the at least one motion activated switch is in the closed position, and the initial charge status corresponds to the arming charge when the at least one motion activated switch is in the open position.

In another aspect, the at least one energy storage element includes a capacitor connected in series with a corresponding at least one resistive element and the corresponding at least one motion activated switch. The method may further include discharging energy stored in the capacitor when the corresponding motion activated switch is moved from the open position to the closed position.

In another aspect, the method may include communicating the determined motion to an off-board system. For example, the method may include communicating a request for movement authorization to the off-board system.

In an example of the present inventive subject matter, a motion switch module configured to be operably coupled with an axle of a vehicle includes plural motion activated switches, an inner ring, an outer, and an actuator. The plural motion activated switches movable between an open position and a closed position responsive to movement of the axle. Each motion activated switch includes a button. The inner ring includes plural openings corresponding to the motion activated switches. Each opening is configured to accept a corresponding button of the corresponding motion activated switch. The outer ring is disposed radially outward and concentric with the inner ring. The actuator is configured to rotate with the axle about a center of the inner ring and outer ring. The actuator includes an opening arm configured to move at least one button radially inward to move a corresponding at least one motion activated switch from the closed position to the open position responsive to a rotating of the axle. The actuator also includes a closing shoulder configured to move at least one other button radially outward to move a corresponding least one motion activated switch from the open position to the closed position responsive to the rotating of the axle.

In another aspect, the plural motion activated switches include three motion activated switches spaced about 120 degrees apart from each other. For example, the opening arm may include an opening leading surface configured to initiate radially inward movement of the at least one button, and the closing shoulder may include a closing leading surface configured to initiate radially outward movement of the at least one other button, the opening leading surface and the closing leading surface spaced at least 120 degrees apart.

In another aspect, the outer ring may include plural caps corresponding to the buttons, each cap contacting the corresponding button when the corresponding motion activated switch is in the closed position, and each cap spaced a distance apart from the corresponding when the corresponding motion activated switch is in the open position. For example, the inner ring and the caps may be electrically coupled to plural corresponding energy storage elements. In some examples, the outer ring is electrically insulated.

Various components and modules described herein may be implemented as part of one or more computers, computing systems, or processors. The computer, computing system, or processor may include a microprocessor. The microprocessor may be connected to a communication bus. The computer or processor may also include a memory. The memory may include Random Access Memory (RAM) and Read Only Memory (ROM). The computer or processor further may include a storage system or device, which may be a hard disk drive or a removable storage drive such as a floppy or other removable disk drive, optical disk drive, and the like. The storage system may also be other similar means for loading computer programs or other instructions into the computer or processor. The instructions may be stored on a tangible and/or non-transitory computer readable storage medium coupled to one or more servers.

As used herein, the term "computer," "computing system," "processing system," "processing unit," or "processor" may include any processor-based or microprocessor-based system including systems using microcontrollers, reduced instruction set computers (RISC), application specific integrated circuits (ASICs), logic circuits, and any other circuit or processor capable of executing the functions described herein. The above examples are exemplary only, and are thus not intended to limit in any way the definition and/or meaning of the terms "computer," "computing system," "processing system," "processing unit," or "processor."

The set of instructions may include various commands that instruct the computer or processor as a processing machine to perform specific operations such as the methods and processes described herein. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

As used herein, the terms "system," "unit," and "module" include a hardware and/or software system that operates to perform one or more functions. For example, a system, unit, or module may include electronic circuitry that includes and/or is coupled to one or more computer processors, controllers, or other logic based devices that perform operations based on instructions stored on a tangible and non-transitory computer readable storage medium, such as a computer memory. Alternatively, a system, unit, or module may include a hard-wired device that performs operations based on hard-wired logic of the device. The systems, units, or modules shown in the attached figures may represent the hardware that operates based on software or hardwired instructions, the software that directs hardware to perform the operations, or a combination thereof "Systems," "units," or "modules" may include or represent hardware and associated instructions (e.g., software stored on a tangible and non-transitory computer readable storage medium, such as a computer hard drive, ROM, RAM, or the like) that perform one or more operations described herein. The hardware may include electronic circuits that include and/or are connected to one or more logic-based devices, such as microprocessors, processors, controllers, or the like. These devices may be off-the-shelf devices that are appropriately programmed or instructed to perform operations described herein from the instructions described above. Additionally or alternatively, one or more of these devices may be hard-wired with logic circuits to perform these operations.

It is to be understood that the above description is intended to be illustrative, and not restrictive. For example, the above-described embodiments (and/or aspects thereof) may be used in combination with each other. In addition, many modifications may be made to adapt a particular situation or material to the teachings without departing from its scope. While the dimensions and types of materials described herein are intended to define the parameters, they are by no means limiting and are exemplary embodiments. Many other embodiments will be apparent to one of ordinary skill in the art upon reviewing the above description. The scope should, therefore, be determined with reference to the appended claims, along with the full scope of equivalents to which such claims are entitled. In the appended claims, the terms "including," "includes," and "in which" are used as the plain-English equivalents of the respective terms "comprising," "comprises," and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments, and also to enable any person skilled in the art to practice the embodiments, including making and using any devices or systems and performing any incorporated methods. The patentable scope is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods, without departing from the spirit and scope of the embodiments described herein, it is intended that all of the subject matter of the above description or shown in the accompanying drawings shall be interpreted merely as examples illustrating the inventive subject matter herein and shall not be construed as limiting.

The invention claimed is:

1. A cold movement detection system comprising:

a motion switch module configured to be operably coupled with an axle of a vehicle, the motion switch module comprising at least one motion activated switch, the at least one motion activated switch movable between an open position and a closed position responsive to movement of the axle;

an energy storage module operably coupled to the motion switch module, the energy storage module comprising at least one energy storage element corresponding to the at least one motion activated switch, wherein the at least one energy storage element is configured to discharge a stored charge responsive to the corresponding at least one motion activated switch moving from the open to the closed position;

a resistive module operably coupled to the energy storage module, the resistive module comprising at least one resistive element corresponding to the at least one storage element, the at least one resistive element configured to dissipate energy of the stored charge discharged by the corresponding at least one energy storage module; and an interface configured to provide information regarding a change in charge state of the at least one energy storage element, wherein the change in charge state corresponds to the movement of the vehicle.

2. The system of claim 1, wherein the at least one energy storage element comprises a capacitor connected in series with the corresponding at least one resistive element and the corresponding at least one motion activated switch, wherein a discharging of the capacitor corresponds to the movement of the vehicle.

3. The system of claim 1, wherein the at least one motion activated switch of the motion switch module comprises three motion activated switches spaced about 120 degrees apart from each other.

4. The system of claim 1, wherein the at least one motion activated switch comprises a corresponding at least one button, and wherein the motion switch module comprises:

an inner ring configured to accept the at least one button of the at least one motion activated switch;

an outer ring disposed radially outward and concentric with the inner ring; and an actuator configured to rotate with the axle about a center of the inner ring and outer ring, the actuator including an opening arm configured to move the at least one button radially inward to move the at least one motion activated switch from the closed position to the open position responsive to a rotating of the axle, the actuator including a closing shoulder configured to move the at least one button radially outward to move the at least one motion activated switch from the open position to the closed position responsive to the rotating of the axle.

5. The system of claim 4, wherein the at least one motion activated switch of the motion switch module comprises three motion activated switches spaced about 120 degrees apart from each other.

6. The system of claim 5, wherein the opening arm includes an opening leading surface configured to initiate radially inward movement of the button and the closing shoulder includes a closing leading surface configured to initiate radially outward movement of the button, the opening leading surface and the closing leading surface spaced at least 120 degrees apart.

7. The system of claim 4, wherein the outer ring comprises at least one cap corresponding to the at least one button, the at least one cap contacting the corresponding at least one button when the at least one motion activated switch is in the closed position, the at least one cap spaced a distance apart from the corresponding at least one button when the at least one motion activated switch is in the open position, wherein the charge stored in the at least one storage element is discharged when the corresponding at least one cap contacts the corresponding at least one button.

8. The system of claim 7, wherein the inner ring and the at least one cap are electrically coupled to the at least one energy storage element.

9. The system of claim 8, wherein the outer ring is electrically insulated.

10. A method comprising:

providing an arming charge to at least one energy storage element operably coupled to a motion switch module, the motion switch module operably coupled with an axle of a vehicle, the motion switch module comprising at least one motion activated switch, the at least one motion activated switch movable between an open position and a closed position responsive to movement of the axle;

storing an initial charge status of the at least one energy storage element, the initial charge corresponding to the position of the at least one motion activated switch at an arming time;

reading a subsequent charge status of the at least one storage element; and comparing the subsequent charge status of the at least one storage element to the initial charge status of the at least one energy storage element to determine a motion of the vehicle.

11. The method of claim 10, wherein the initial charge status is about zero when the at least one motion activated switch is in the closed position, and wherein the initial charge status corresponds to the arming charge when the at least one motion activated switch is in the open position.

12. The method of claim 10, wherein the at least one energy storage element comprises a capacitor connected in series with a corresponding at least one resistive element and the corresponding at least one motion activated switch, the method further comprising discharging energy stored in the capacitor when the corresponding motion activated switch is moved from the open position to the closed position.

13. The method of claim 10, further comprising communicating the determined motion to an off-board system.

14. The method of claim 13, further comprising communicating a request for movement authorization to the off-board system.

15. A motion switch module configured to be operably coupled with an axle of a vehicle, the motion switch module comprising:

plural motion activated switches movable between an open position and a closed position responsive to movement of the axle, each motion activated switch comprising a button;

an inner ring comprising plural openings corresponding to the motion activated switches, each opening configured to accept a corresponding button of the corresponding motion activated switch;

an outer ring disposed radially outward and concentric with the inner ring; and an actuator configured to rotate with the axle about a center of the inner ring and outer ring, the actuator including an opening arm configured to move at least one button radially inward to move a corresponding at least one motion activated switch from the closed position to the open position responsive to a rotating of the axle, the actuator including a closing shoulder configured to move at least one other button radially outward to move a corresponding least one motion activated switch from the open position to the closed position responsive to the rotating of the axle.

16. The motion switch module of claim 15, wherein the plural motion activated switches comprise three motion activated switches spaced about 120 degrees apart from each other.

17. The motion switch module of claim 16, wherein the opening arm includes an opening leading surface configured to initiate radially inward movement of the at least one button and the closing shoulder includes a closing leading surface configured to initiate radially outward movement of the at least one other button, the opening leading surface and the closing leading surface spaced at least 120 degrees apart.

18. The motion switch module of claim 15, wherein the outer ring comprises plural caps corresponding to the buttons, each cap contacting the corresponding button when the corresponding motion activated switch is in the closed position, each cap spaced a distance apart from the corresponding when the corresponding motion activated switch is in the open position.

19. The motion switch module of claim 18, wherein the inner ring and the caps are electrically coupled to plural corresponding energy storage elements.

20. The motion switch module of claim 19, wherein the outer ring is electrically insulated.

* * * * *